United States Patent [19]

Pielsticker et al.

[11] 4,040,514

[45] Aug. 9, 1977

[54] LIFTING BEAM COOLING AND CONVEYING BED

[75] Inventors: Klaus Peter Pielsticker, Dusseldorf; Friedel Mogendorf, Duisburg; Karl Heinrich Sonnabend, Ratingen, all of Germany

[73] Assignee: Schloemann-Siemag-Aktiengesellschaft of Duesseldorf, Germany

[21] Appl. No.: 707,484

[22] Filed: July 22, 1976

[30] Foreign Application Priority Data

Aug. 1, 1975 Germany ..... 2534363

[51] Int. Cl.[2] ..... B65G 25/04

[52] U.S. Cl. ..... 198/774

[58] Field of Search ..... 198/773, 774

[56] References Cited

U.S. PATENT DOCUMENTS

| | | | |
|---|---|---|---|
| 3,416,646 | 12/1968 | Boos et al. | 198/774 |
| 3,417,858 | 12/1968 | Heard | 198/774 |
| 3,557,942 | 1/1971 | Simon et al. | 198/774 |
| 3,850,287 | 11/1974 | Petros | 198/774 |

*Primary Examiner*—Evon C. Blunk
*Assistant Examiner*—Joseph E. Valenza

[57] ABSTRACT

A lifting beam cooling and conveying bed has the lifting beams subdivided transversely across the conveyor and joined by articulated joints. The divided parts of the lifting beams are supported on profiled tracks which run on rollers. As the lifting beams travel in the conveying direction, they are raised or lowered according to the profile of their respective tracks, and the divided parts all have different sequences of vertical movements.

4 Claims, 5 Drawing Figures

70
15
9''
7
6''
11
73
12
4''
18
16
22
20
9
21
6
II
4
8
5
19
4'
6'
9'
14
19
17
II 2
3
1
6
7
9
79
79
6
7
9
4
3
1

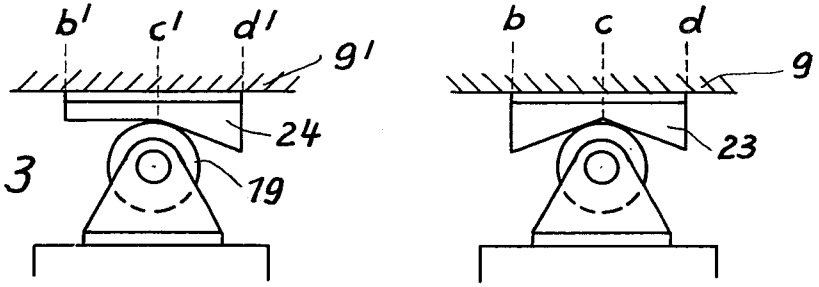
Fig. 3
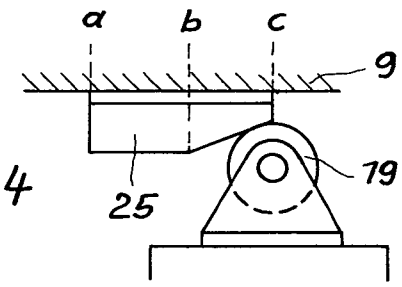
Fig. 4
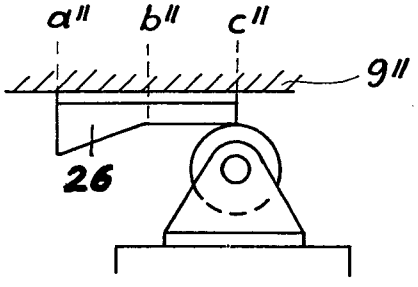
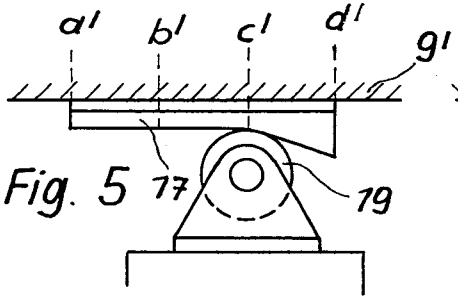
Fig. 5
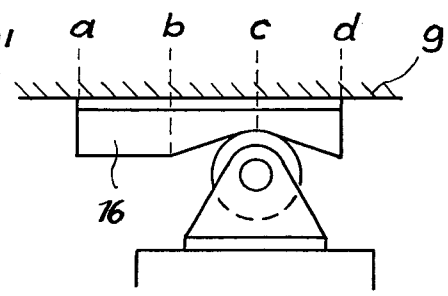
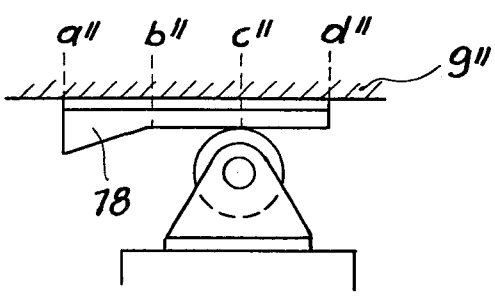

LIFTING BEAM COOLING AND CONVEYING BED

This invention relates to a lifting beam cooling and cross-conveying bed for cooling and transversely conveying plates.

It is an object of the invention to provide a lifting beam cooling and conveying bed which has end portions respectively for receiving and transferring plates from or to a feed or discharge device, wherein the lifting motion of the end portions and of the central portion of the cooling bed can take place independently of each other without the use of special drive means for each portion.

According to the invention, there is provided a lifting beam cooling and cross-conveying bed which comprises stationary support beams and movable support beams, the movable beams being divided into portions and the portions being articulated together, and a support arrangement for the movable beams which comprises transversely movable support members which are also divided into portions and articulated and on which the movable beams are supported, profiled tracks mounted on the underside of the support members, and rollers on which the tracks run, and wherein the profiles of the tracks are such that when the movable beams are driven in a conveying direction, the individual portions can be either raised or lowered or maintained in a raised or lowered position, with the different portions being subjected to different vertical movement sequences.

The tracks can be made up from horizontal and inclined track sections arranged so as to produce the desired vertical movement sequence as the rollers run along the tracks.

The inclined tracks of the central portion support pieces are preferably each interrupted by a horizontal section, the positon of which corresponds to the position of the rolling elements in which the upper edge of the mobile support grids is aligned with the upper edge of the stationary support grids. By this means, all areas of the plates can be held in contact with the stationary and mobile support grids for the same period of time, to give particularly uniform cooling.

The invention will now be further described, by way of example, with reference to the accompanying drawings, in which:

FIGS. 3–5 shows different track forms for the support of the movable support grid portions.

Figure 1:
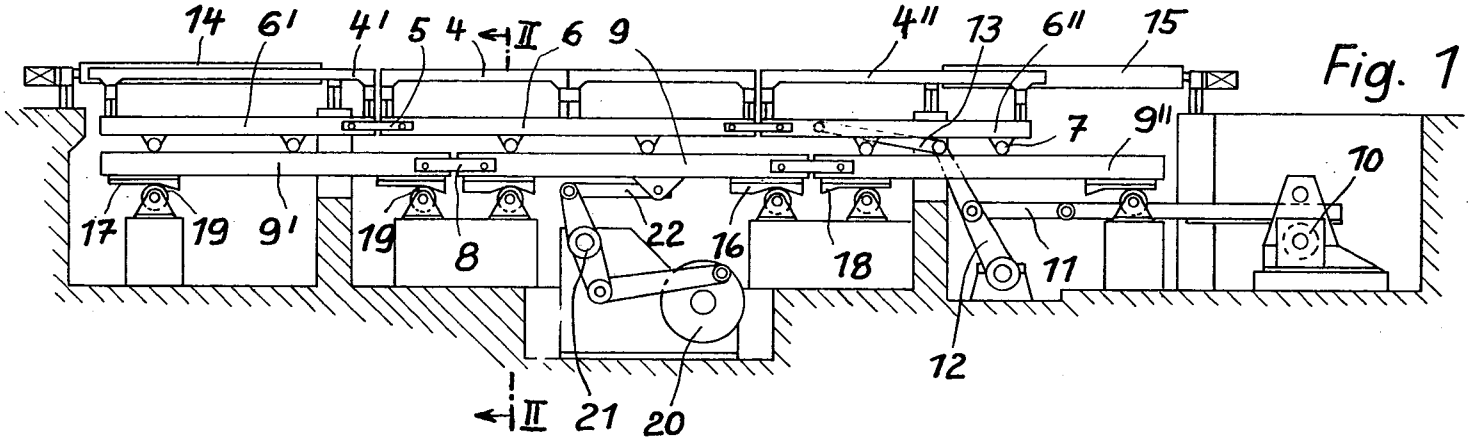
FIG. 1 is a longitudinal section through a lifting beam cooling bed according to the invention with a roller table disposed at each end.
Figure 2:
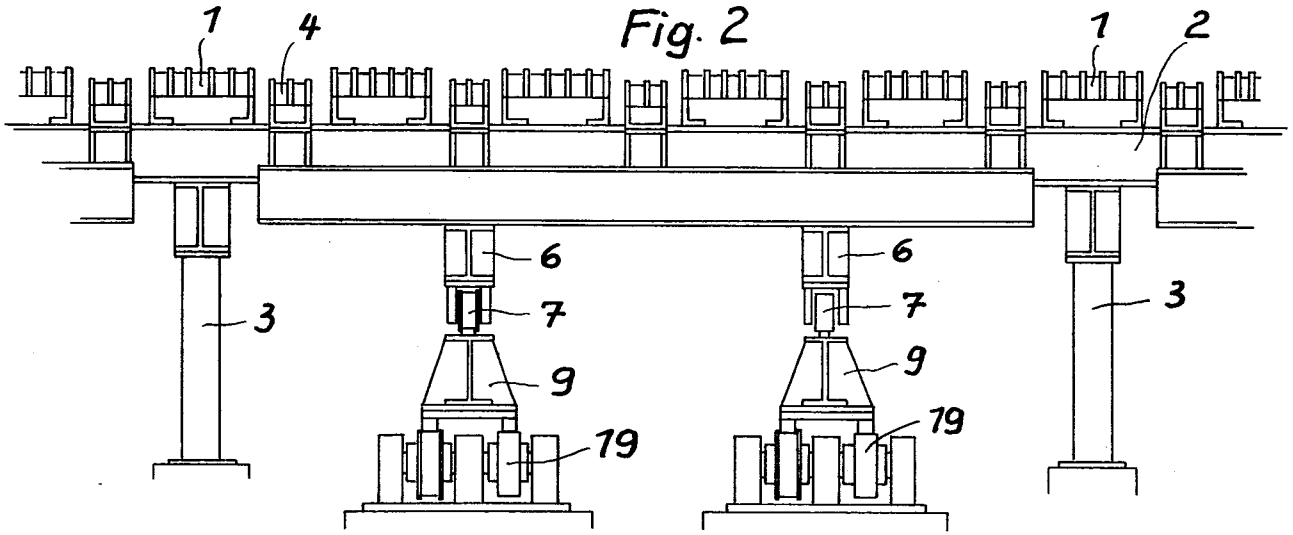
FIG. 2 is a cross-section on the line II—II of FIG. 1.

In the lifter-type cooling bed shown in FIGS. 1 and 2, stationary support grids 1 are connected to the foundations by way of supports 2 and vertical columns 3. Movable support grids on longitudinal supports 6, 6', 6'' joined together by fishplates 5, and consisting of a central portion 4 and two end portions 4', 4'', are disposed between the stationary support grids 1. The longitudinal supports 6, 6', 6'' are movable on support pieces 9, 9',9'', joined together by fishplates 8 and provided with rollers 7. A rack and pinion 10 are provided as drive for the longitudinal supports 6, 6', 6'' and therefore for the movable support grids 4, 4', 4'', and are connected to the longitudinal support 6'' by way of a connecting rod 11, a swivel are 12 supported on the foundations and a guide rod 13. The path of movement of the end portions 4', 6' of the movable support grids extends into the region of the feed roller table 14, and the path of movement of the end portions 4'', 6'' extends into the region of a discharge roller table 15. A special transfer device is therefore superfluous.

To obtain vertical lifting of the movable support grids 4, 4', 4'', tracks 16, 17, 18 are fixed to the undersides of the support pieces 9, 9', 9'', and are supported on rollers 19 mounted on the foundations. The support pieces 9, 9', 9'' are driven by a crank assembly 20 disposed on the foundations, and connected by a swivel lever 21 and guide rod 22 to the support piece 9.

FIGS. 3 and 4 show track forms for a cooling bed comprising a central portion 4 and end portions 4' or 4'' which move into the region of a feed roller table 14 or a discharge roller table 15 respectively.

With the formation shown in FIG. 3, tracks 23 on the support pieces 9 of the central portion 4 of the movable support grid consist of two sections *b-c* and *c-d* inclined towards each other. To these sections there correspond sections *b'-c'* and *c'-d'* of track 24 on the support piece 9' of an end portion of the support grid. (By "correspond" is meant that the particular track sections referred to are in contact with their respective rollers 19 at the same time.) A common lifting and conveying movement of the main portion 4 and end portion 4' or 4'' is obtained with the sections *c-d* and *c'-d'*. In the region of the sections *b-c* and *b'-c'*, there is a lifting movement of the main portion 4 while the end portion 4' or 4'' remains in the lowered position. In this manner the central portion of the cooling bed can be moved vertically together with an end portion during transfer from the feed roller table or to discharge roller table. During the arrival of plates on the roller table or their discharge therefrom, the main portion may be moved vertically alone while the end portion remains lowered.

FIG. 4 shows a modificaton of the support tracks supporting a central portion 4 and end portion 4', 4''. In this case the track 25 on the support piece 9 of the central portion 4 consists of an inclined section *b-c* and a horizontal section *a-b* extending from the upper edge of the inclined section *b-c*. The track 26 of end portion 4' or 4'' consists of an inclined section *a''-b''* and a horizontal section *b''-c''* extending from the lower edge of the inclined section. This formation allows the combination of a vertical movement of the main portion 4 with the maintaining of the end portion 4' or 4'' in the lowered position, and maintaining the main portion 4 in its raised position in combination with a vertical movement of the end portion 4' or 4''. This prevents plates of widths greater than the horizontal conveying stroke of the movable support grids from becoming damaged by tipping over during transfer from or to the roller table.

Finally, FIG. 5 shows tracks 16, 17, 18 in a cooling bed with a movable support grid comprising a central portion 4 and two end portions 4' and 4''. The track 16 of the support pieces 9 for the main portion 4 consists in this case of sections *b-c* and *c-d* inclined towards each other, and a horizontal section *a-b* extending from the lower edge of the inclined section *b-c*. Horizontal sections *b''-c''*and *c''-d''*on the track 18 of the end portion 4'' correspond to the inclined sections *b-c* and *c-d*, while an inclined section *a''-b''*is associated with the horizontal section *a-b*. The track 17 on the support piece 9' of the end portion 4' likewise consists of two horizontal sections *a'-b'* and *b'-c'* and an inclined section *c'-d'*, which is associated with the inclined section *c-d* on the track 16.

In this case the following combinations of vertical movements and rest situations are possible:

Section *a-b*; raised position of the central portion 4, lowered position of the end portion 4' and vertical movement of the end portion 4''.

In this manner, in the region of the track sections *a-b*, *a'-b'* and *a''-b''*, there is the combination of a lifting movement of the end portion 4'' with a raised position of the central portion 4 and a lowered position of the end portion 4'. In the region of the track sections *b-c*, *b'-c'* and *b''-c''* a lifting movement of the central portion 4 may be combined with a lowered position of the end portions 4' and 4'' . Finally, the track sections *c-d*, *c'-d'* and *c''-d''* allow a lifting movement of the central portion 4 and end portion 4' with a lowered position of the end portion 4''.

Horizontal sections are arranged between the inclined sections of the central portion tracks, and when the rollers are in contact with these portions, the upper surfaces of the movable grids lie at the same level as the upper surfaces of the fixed grids, so that the cooling conditions are constant over the transverse dimension of the material being conveyed.

The invention is not limited to the illustrated track formations. Thus for example by adding a respective horizontal or inclined section to the tracks illustrated in FIGS. 3–5, further combinations of rest positions and vertical movements of the central and end portions are obtainable.

We claim:

1. A lifting beam cooling and cross-conveying bed which comprises stationary support beams and movable support beams, the movable beams being divided into portions and the portions being articulated together, and a support arrangement for the movable beams which comprises transversely movable support members which are also divided into portions and articulated and on which the movable beams are supported, profiled tracks mounted on the undersides of the support members, and rollers on which the tracks run, and wherein the profiles of the tracks are such that when the movable beams are driven in a conveying direction, the individual portions can be either raised or lowered or maintained in a raised or lowered position, with the different portions being subjected to different vertical movement sequences.

2. A bed as claimed in claim 1, wherein the movable beams have opposite end portions, which can be raised respectively into and out of respective feed and delivery roller tables, and a central portion intermediate the tables and wherein the tracks associated with the central portion comprise two oppositely inclined sections, and the tracks associated with the end portions comprise an inclined section and a horizontal section arranged so that one of the end portions is raised to its feed table at the beginning of a transverse movement forming a conveying stroke, and the other end portion is raised to its feed table at the beginning of a transverse movement forming a conveying stroke, and the other end portion is raised at the end of the conveying stroke.

3. A bed as claimed in claim 2, wherein the tracks associated with the central portion comprise two inclined sections and one horizontal section for holding the central portion raised, and the tracks associated with the end portions comprise one inclined section and two horizontal sections for holding the end portions lowered, the inclined section associated with one of the end portions corresponding to one inclined section of the central portion and the inclined section associated with the other end portion corresponding to the horizontal section on the central portion.

4. A bed as claimed in claim 3, wherein the tracks on which the central portion are supported include sections which, when the respective rollers contact them, support the movable beams with their upper edges at the same height as those of the stationary beams.

* * * * *